US010518551B1

(12) United States Patent
McConville et al.

(10) Patent No.: US 10,518,551 B1
(45) Date of Patent: Dec. 31, 2019

(54) SYSTEM AND METHOD FOR ATTENUATING THE DRYING OF INK FROM A PRINTHEAD

(71) Applicant: Xerox Corporation, Norwalk, CT (US)

(72) Inventors: Paul J. McConville, Webster, NY (US); Christopher D. Atwood, Rochester, NY (US); Seemit Praharaj, Webster, NY (US); Michael J. Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/215,806

(22) Filed: Dec. 11, 2018

(51) Int. Cl.
*B41J 2/175* (2006.01)

(52) U.S. Cl.
CPC ..... *B41J 2/17596* (2013.01)

(58) Field of Classification Search
CPC ..... B41J 2/17596
See application file for complete search history.

(56) References Cited

U.S. PATENT DOCUMENTS

| | | | |
|---|---|---|---|
| 4,296,418 | A | 10/1981 | Yamazaki et al. |
| 4,364,065 | A | 12/1982 | Yamamori et al. |
| 4,947,187 | A | 8/1990 | Iwagami |
| 5,394,178 | A | 2/1995 | Grange |
| 5,635,965 | A | 6/1997 | Purwins et al. |
| 5,936,647 | A | 8/1999 | Rhodes et al. |
| 5,980,622 | A | 11/1999 | Byers |
| 7,156,514 | B2 | 1/2007 | Rosa |
| 7,753,475 | B2 | 7/2010 | Berry et al. |
| 7,992,986 | B2 | 8/2011 | Snyder et al. |
| 8,592,503 | B2 | 11/2013 | Bogale et al. |
| 2003/0231222 | A1 | 12/2003 | Jefferson et al. |
| 2008/0204501 | A1 | 8/2008 | Kurita et al. |
| 2009/0237424 | A1 | 9/2009 | Martin et al. |
| 2010/0073445 | A1 | 3/2010 | Silverbrook et al. |
| 2011/0267406 | A1* | 11/2011 | Hanson ..... B41J 2/175 347/85 |
| 2013/0215189 | A1 | 8/2013 | Justice et al. |

FOREIGN PATENT DOCUMENTS

| | | | |
|---|---|---|---|
| EP | 1 827 839 | B1 | 2/2009 |
| KR | 10-1397307 | B1 | 5/2014 |
| WO | 2008-026417 | A1 | 3/2008 |

OTHER PUBLICATIONS

IP.com search (Year: 2019).*
Kwon et al.; Measurement of inkjet first-drop behavior using a high-speed camera; Review of Scientific Instruments; Mar. 2, 2016; vol. 87—Issue No. 3; AIP Publishing.

* cited by examiner

*Primary Examiner* — Lisa Solomon
(74) *Attorney, Agent, or Firm* — Maginot Moore & Beck LLP

(57) ABSTRACT

An ink reservoir in an ink delivery system of an inkjet printer is selectively pressurized and depressurized to fluctuate an ink meniscus at the nozzle of each inactive inkjet in the printhead connected to the ink reservoir. The cycle of pressurization and depressurization is repeated for a predetermined number of times to replenish ink at the nozzles and reduce the likelihood of the ink at the nozzles obtaining a high viscosity.

20 Claims, 6 Drawing Sheets

SYSTEM AND METHOD FOR ATTENUATING THE DRYING OF INK FROM A PRINTHEAD

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 6. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to selectively block the conduit 634. A valve 612 is also provided in the conduit 614 connecting an air pressure pump 616 to the ink reservoir 604 and this valve remains open except during purging operations.

When a new printhead is installed or its manifold needs to be flushed to remove air in the conduit 618, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system 20 are primed since no air is present in the conduits or the printhead. The ink reservoir is then resupplied to bring the height of the ink to a level where the distance between the level in the reservoir and the printhead inkjets is D, as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

Some inkjet imaging devices use inks that change from a low viscosity state to a high viscosity state relatively quickly. When the valve 612 is open and the ink reservoir 604 is at atmospheric pressure during printing, a meniscus in the ink at the nozzle 630 of each inactive inkjet obtains the shape shown in FIG. 7. When the time between print jobs or the time between operations of some inkjets exceeds some duration, solvent, such as water, evaporates from the ink. This evaporation occurs most quickly at the edges of the nozzles, which are located in the dashed circles in FIG. 7, since the ink is thinnest at these positions. As the viscosity of the ink increases from this evaporation, the ink begins to adhere to the bore of the nozzle 630 and the inkjets can become clogged. Although the controller 80 can perform a purging operation to purge the high viscosity ink from the inkjets and bring fresh ink into the inkjets of the printhead, this purging operation can waste ink otherwise available for printing. Reducing the need for frequent purging with quickly drying inks would be beneficial.

SUMMARY

A method of inkjet printer operation enables ink at the nozzles of a printhead to maintain a low viscosity state. The method includes operating with a controller a valve operatively connected between an air pressure pump and an ink reservoir connected to a printhead to connect the air pressure pump to the ink reservoir, activating with the controller the air pressure pump to apply pressure to ink in the ink reservoir to extend an ink meniscus at inactive inkjets in the printhead without breaking the ink meniscus, and operating with the controller the valve to disconnect the air pressure pump from the ink reservoir and vent the ink reservoir to atmospheric pressure to retract the ink meniscus at the inactive inkjets.

An inkjet printer implements the method that enables ink at the nozzles of a printhead to maintain a low viscosity state. The printer includes a printhead, an ink reservoir operatively connected to the printhead to provide ink to the printhead, an air pressure pump operatively connected to the ink reservoir, the air pressure pump being configured to apply pressure to ink in the ink reservoir and the printhead, a valve operatively connected between the ink reservoir and the air pressure pump, the valve being configured to be moved to a first position where the ink reservoir is vented to atmosphere pressure and to a second position where the air pressure pump applies pressure to the ink reservoir, and a controller operatively connected to the valve and the air pressure pump. The controller is configured to operate the valve to connect the air pressure pump to apply pressure sufficient to extend an ink meniscus at inactive inkjets in the printhead without breaking the ink meniscus and to operate the valve to disconnect the air pressure pump from the ink reservoir and vent the ink reservoir to atmospheric pressure to retract the ink meniscus at the inactive inkjets.

BRIEF DESCRIPTION OF THE DRAWINGS

The foregoing aspects and other features of a system and method that enable ink at the nozzles of a printhead to maintain a low viscosity state are explained in the following description, taken in connection with the accompanying drawings.

DETAILED DESCRIPTION

Figure 1:
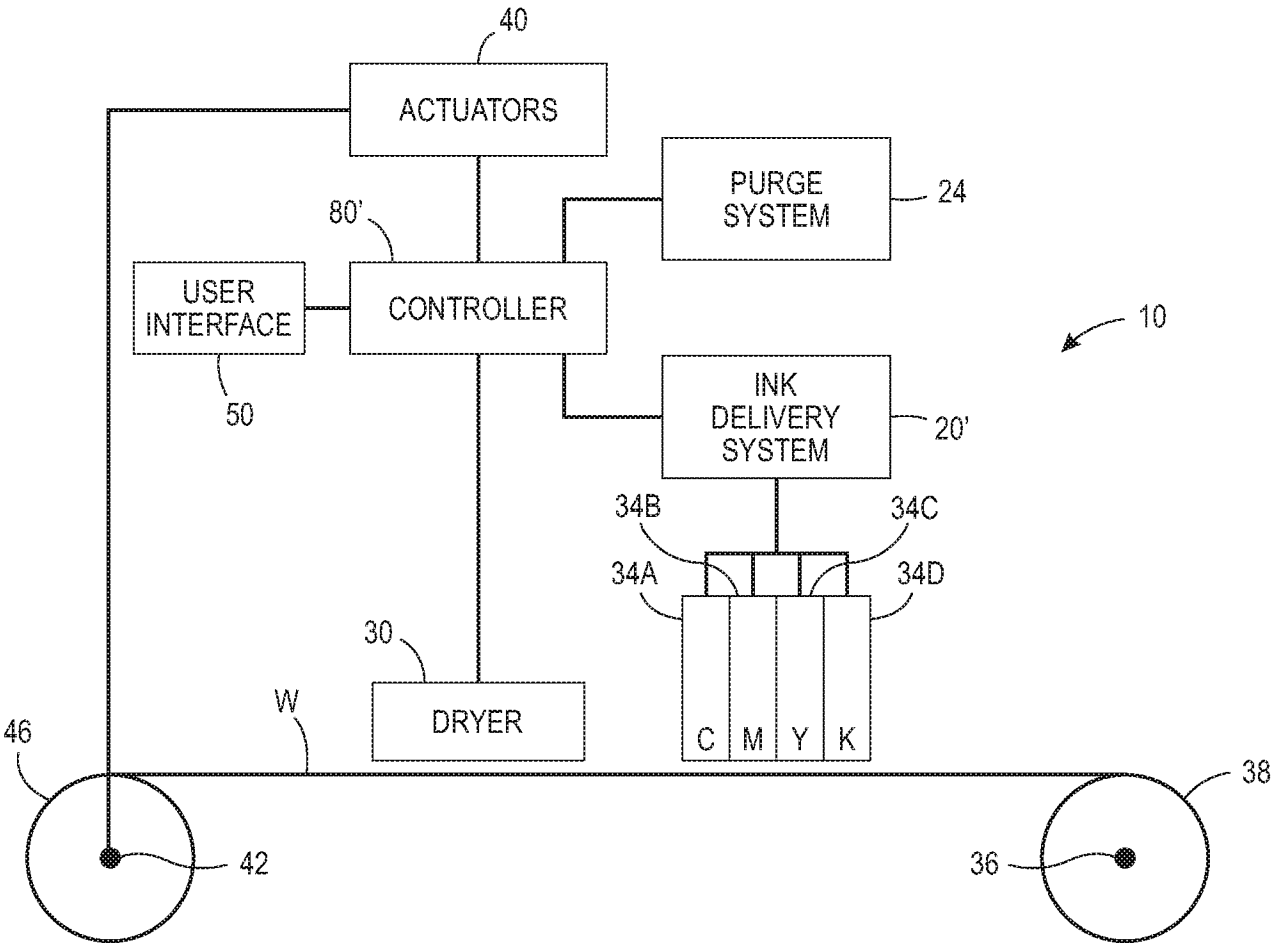
FIG. 1 is a schematic drawing of an aqueous inkjet printer that prints ink images directly to a web of media and that attenuates evaporation of fast drying inks from the printheads of the printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for operating inkjets in an inkjet printer to reduce evaporation of ink at the nozzles of inkjets in the printheads. The reader should also appreciate that the principles set forth in this description are applicable to similar imaging devices that generate images with pixels of marking material.

FIG. 1 illustrates a high-speed aqueous ink image producing machine or printer 10 in which a controller 80' has been configured to perform the process 400 described below to operate the ink delivery system 20' (FIG. 2) so the ink at the nozzles of the printheads 34A, 34B, 34C, and 34D maintain a low viscosity state during periods of inactivity. As illustrated, the printer 10 is a printer that directly forms an ink image on a surface of a web W of media pulled through the printer 10 by the controller 80' operating one of the actuators 40 that is operatively connected to the shaft 42 about which a take up roll 46 is mounted. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction.

Figure 6:
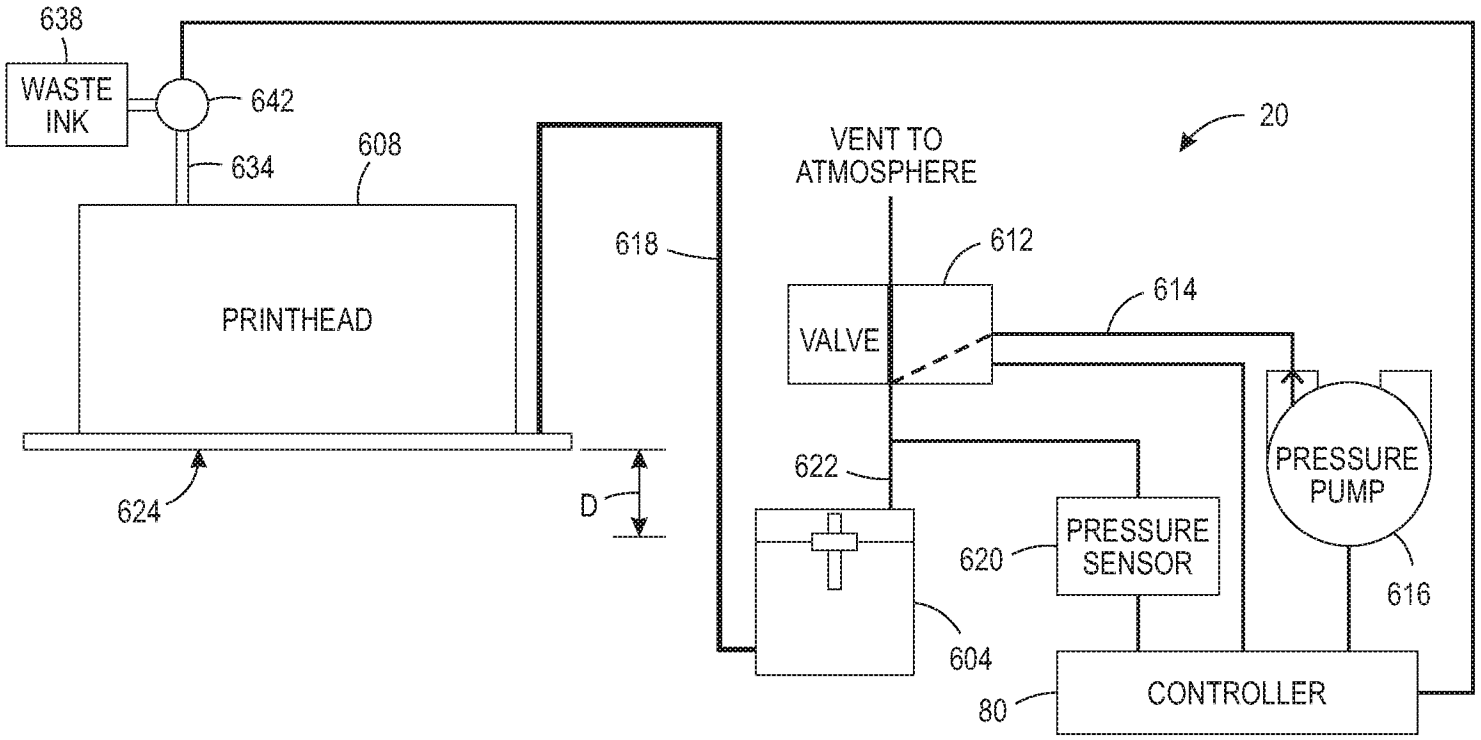
FIG. 6 PRIOR ART
FIG. 6 is a schematic diagram of a prior art ink delivery system that is used in prior art printers for purging only.

The aqueous ink delivery subsystem 20' has at least one ink reservoir containing one color of aqueous ink. Since the illustrated printer 10 is a multicolor image producing machine, the ink delivery system 20' includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described with reference to the process 400 below, to attenuate evaporation of the ink from the printheads. Additionally, although not shown in FIG. 1, each printhead in a printhead module is connected to a corresponding waste ink tank with a valve as described previously with reference to FIG. 6 to enable the manifold and inkjet purge operations previously described. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by controller 80' operating one or more actuators 40 to rotate the shaft 42 on which the take up roll 46 is placed to pull the web from the media roll 38 as it rotates about the shaft 36. When the web is completely printed, the take-up roll can be removed from the shaft 42 for additional processing. Alternatively, the printed web can be directed to other processing stations (not shown) that perform tasks such as cutting, collating, binding, and stapling the media. Alternatively, ink images can be printed on individual sheets of media rather than web W.

Operation and control of the various subsystems, components and functions of the machine or printer 10 are performed with the aid of a controller or electronic subsystem (ESS) 80'. The ESS or controller 80' is operably connected to the components of the ink delivery system 20', the purge system 24, the printhead modules 34A-34D (and thus the printheads), the actuators 40, and the heater 30. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50, and accordingly executes such controls. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 2:
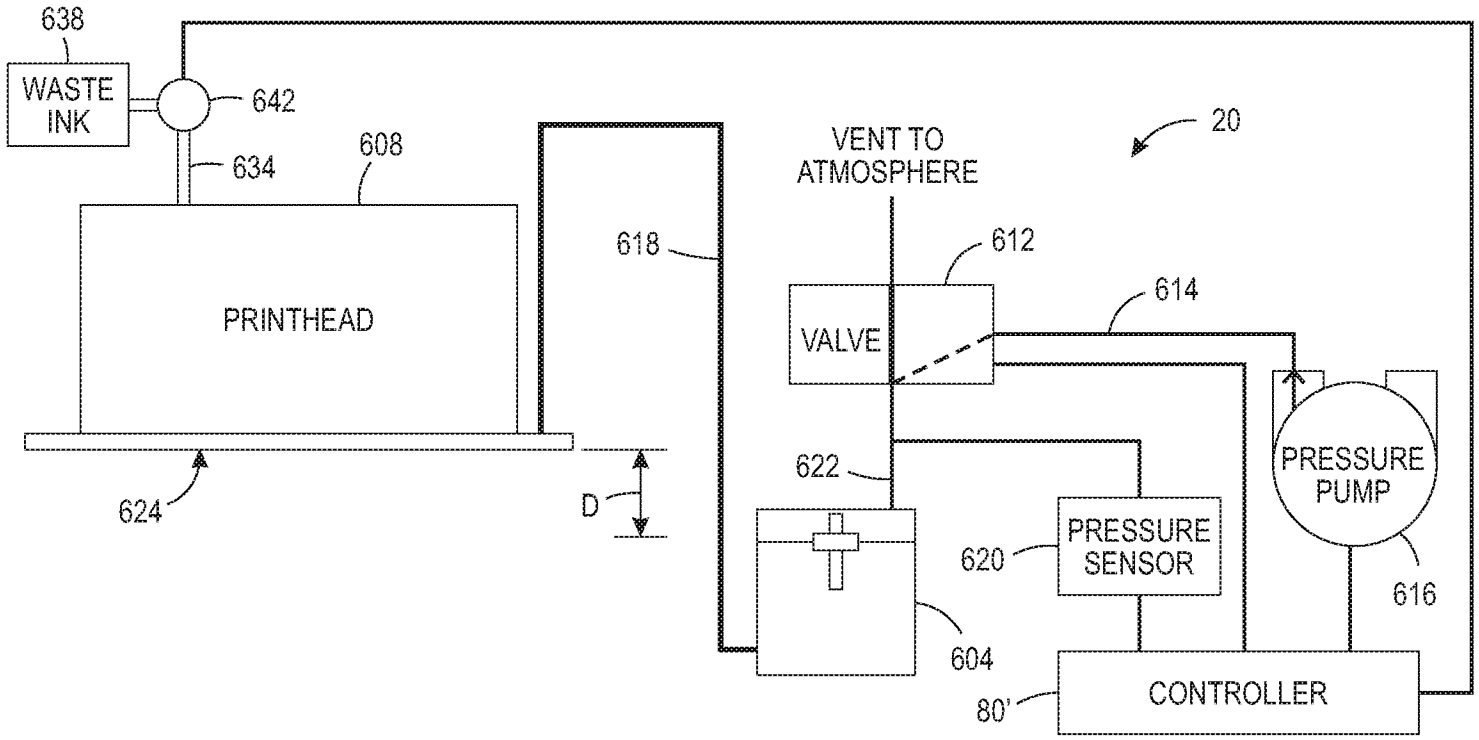
FIG. 2 is a schematic diagram of an ink delivery system that is used in the printer shown in FIG. 1 to attenuate the evaporation of fast drying inks from the printheads of the printer.
Figure 3:
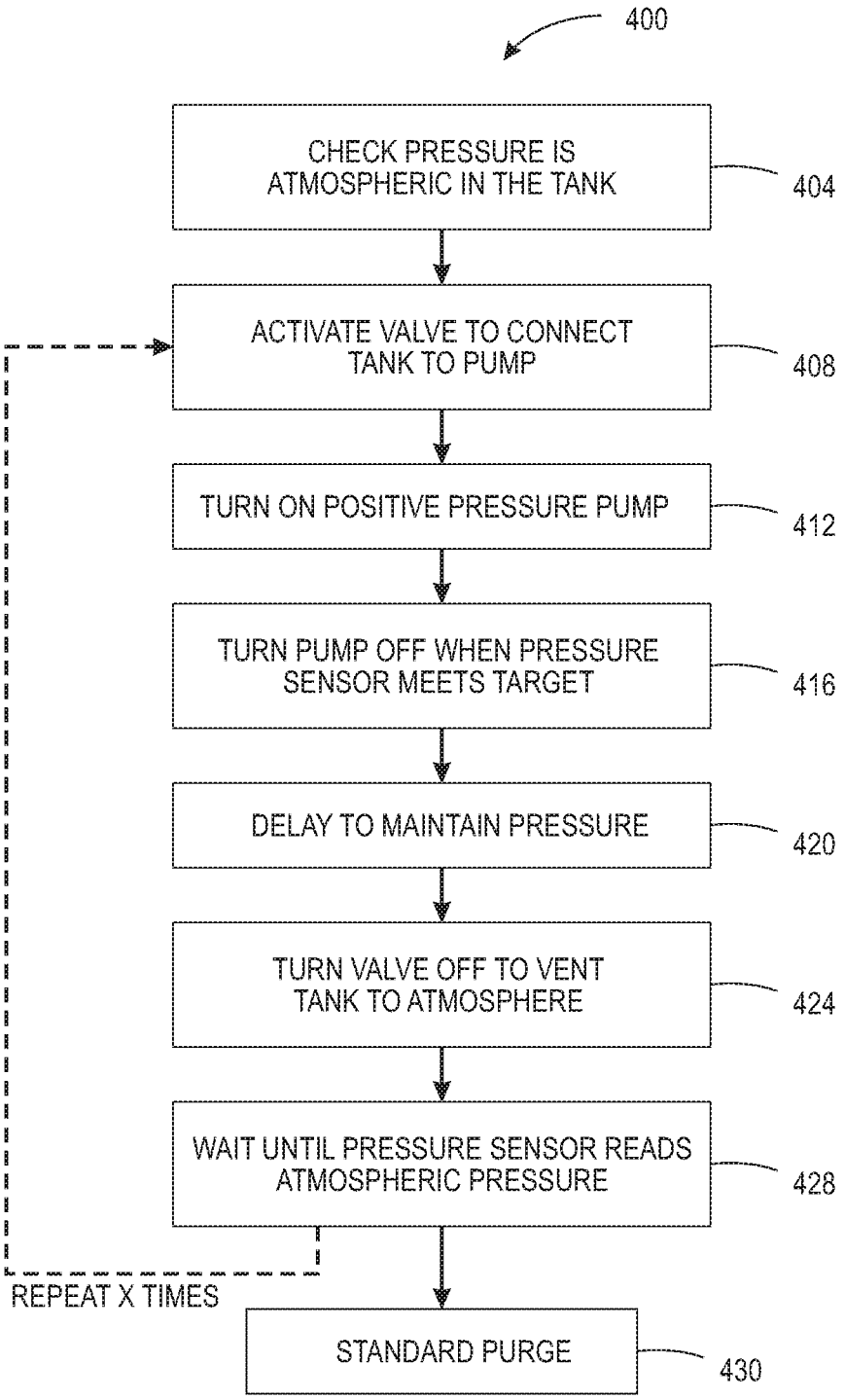
FIG. 3 is a flow diagram of a process for operating the ink delivery system of the printers of FIG. 1 and FIG. 2 so evaporation of fast drying inks from the printheads of the printers is reduced.

Using like numbers for like components, an ink delivery system that can attenuate the evaporation of quickly drying inks from printheads is shown in FIG. 2. This system 20' differs from the one shown in FIG. 6 in that controller 80' is configured to perform the process 400 shown in FIG. 3 during print jobs and between print jobs to reduce ink drying at the nozzles of the printhead supplied by the ink reservoir 604. FIG. 3 depicts a flow diagram for the process 400 that operates the ink delivery system 20' to fluctuate the meniscus of ink at the nozzles in the printhead 608 to keep the viscosity of the ink in the nozzle at its low viscosity. In the discussion below, a reference to the process 400 performing a function or action refers to the operation of a controller, such as controller 80', to execute stored program instructions to perform the function or action in association with other components in the printer. The process 400 is described as being performed by an ink delivery system 20' in the printer 10 of FIG. 1 for illustrative purposes.

Figure 7:
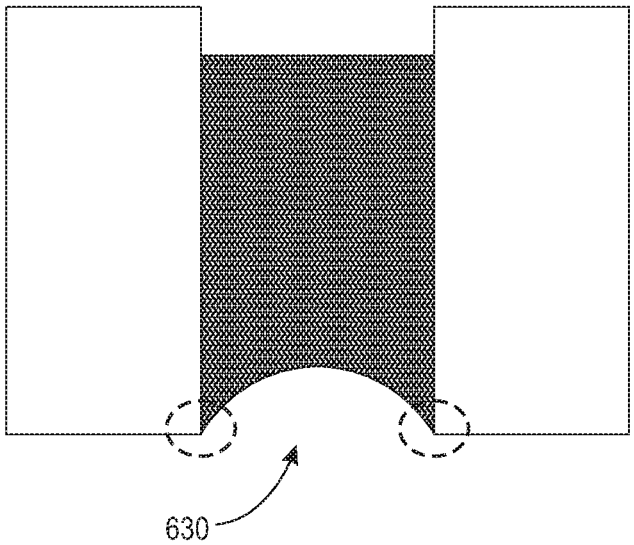
FIG. 7 PRIOR ART
FIG. 7 illustrates the ink meniscus at a nozzle of an inactive inkjet in a prior art printhead except during purging operations.

During printing operations, the ink delivery system 20' and the printhead 608 are fully primed, which means ink fills the conduit between the waste tank and the manifold outlet of the printhead, the manifold and the inkjets of the printhead are full of ink, and the conduit 618 between the manifold inlet and the ink reservoir is full of ink. When the printer 10 is going to enter a period of inactivity or inkjets in the printhead 608 have been inactive for a period of time that makes higher viscosity ink at the nozzles possible, the process 400 is performed. The process begins with the controller verifying that pressure in the ink reservoir is at atmospheric pressure (block 404). The controller can perform this verification by checking the status of the valve 612 or by comparing the signal from the sensor 620 to a reference atmospheric pressure. The process then actuates the valve 612 to connect the air pressure pump 616 to the ink reservoir 604 (block 408). When the processing of these two blocks are performed, the pressure in the ink reservoir is represented by segment 504 of the graph shown in FIG. 4 and the meniscus of aqueous ink at inactive inkjets appears as shown in FIG. 7. The process continues with the controller 80' operating the air pressure pump to apply positive air pressure to the ink in the ink reservoir 604 (block 412). The controller then monitors the signal from the sensor 620 until the pressure reaches a predetermined threshold (block 416). Thus, the pressure in the ink reservoir changes until it reaches the threshold as indicated by the segment 508 in the graph of FIG. 4. At this pressure, the ink meniscus of the aqueous ink at the inactive nozzles in the printhead appear as shown in FIG. 5. The pressure corresponding to the predetermined threshold is sufficient to extend the meniscus beyond the nozzle opening 630 but the pressure is not sufficient to break the meniscus. In one embodiment, such a pressure is within a range of about 0.05 psi to about 0.45 psi, but the range depends upon a number of factors, such as the diameter of the tubes connecting the ink reservoir and the printhead, the number of printheads connected to the ink reservoir, the size of the ink reservoir and the ink manifold in the printhead, and the number of inkjets in the printhead or printheads, for example. The controller 80' waits for a predetermined time period (block 420) and then operates the valve to connect the ink reservoir 604 to atmosphere again (block 424). The duration of the predetermined time period needs to be sufficient to enable fresh ink to reach the nozzle opening 630 to help replenish the solvent in the ink at the ink meniscus. In one embodiment, the predetermined time period is in a range of about 10 msec to about 500 msec, but again the length of the time period depends upon the printhead configuration and related factors, for example. The pressure remains at the predetermined pressure as indicted by the segment 512 in the graph of FIG. 4 until the pressure begins to fall, as shown by segment 516 of FIG. 4, once the valve is opened. The controller 80" monitors the signal from the pressure sensor to verify the pressure in the ink reservoir 604 returns to atmospheric pressure and remains at atmospheric pressure for a predetermined period of time (block 428), as indicated by the segment 520 in FIG. 4. The processing of blocks 408 to 428 is repeated for a predetermined number of times to fluctuate the meniscus at the inactive inkjets in the printhead 624. In one embodiment, the predetermined number of times for performing the cycle is 1 to about 10 times, but the number of times depends upon various factors such as the viscosity of the ink, the time between the performance of the repeated cycles, and the like, for example. The fluctuations of the meniscus replenish the solvent in the ink at the nozzle 630, which reduces the amount of ink evaporation at the nozzles. Thus, purges are needed less frequently and ink is preserved for printing rather than inkjet renewal.

Figure 4:
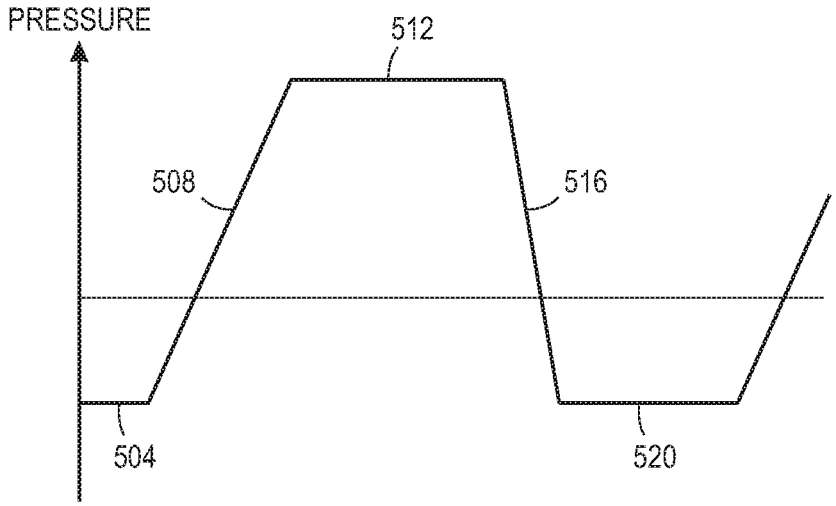
FIG. 4 is a graph of the pressure in the ink reservoir as the process of FIG. 3 is performed.
Figure 5:
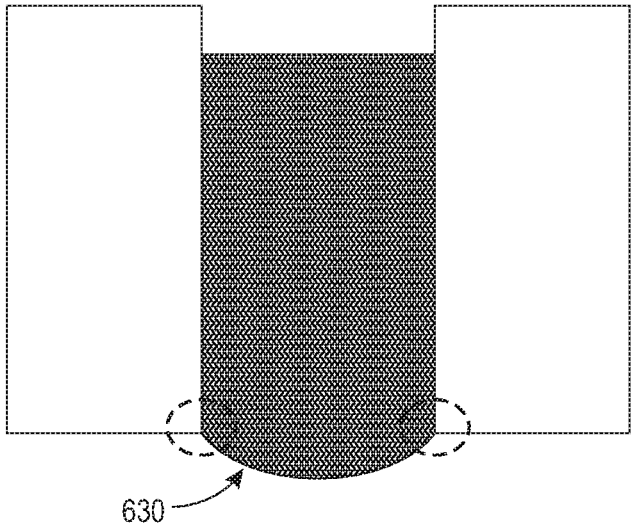
FIG. 5 illustrates the ink meniscus at a nozzle of a printhead when pressure is elevated during the process of FIG. 3.

Although the process of FIG. 4 has been described as addressing evaporation issues occurring with aqueous ink at the nozzles of inactive nozzles, the process can also be applied to inks that present convex meniscus at the nozzles, such as UV curable inks. The convex meniscus of UV curable inks, for example, may partially cure if they remain relatively still in the presence of UV radiation, which may be present in a printer. Performing the process of FIG. 4 to the UV ink reservoir to fluctuate the meniscus of the ink at inactive inkjets has a similar effect by refreshing the ink at the nozzle openings. This action forestalls partially curing of the ink at the nozzles and preserves the operational ability of the inkjets.

FIG. 2 shows one ink delivery system 20' configured to supply ink to a single printhead. In such embodiments, an ink delivery system can be provided for each printhead in the printer. In other embodiments, the ink delivery system 20' can be configured to supply multiple printheads with the same color ink. Thus, one ink delivery system can be configured to supply ink to all the printheads within one of the printhead modules 34A, 34B, 34C, and 34D or multiple ink delivery systems can be configured to supply ink to different printheads in a printhead module in a one-to-one correspondence. The ink delivery systems are operated during print jobs to fluctuate the meniscus at inactive inkjets so they do not become clogged with high viscosity ink at their nozzles. The fluctuating meniscus does not interfere with the ejection of ink drops at the inkjets being used for printing during the print job. Between print jobs or during inactive periods, the ink delivery system 20' continues to perform the process 400 to fluctuate the ink meniscus at the nozzles to reduce evaporation at the nozzles and preserve the operational ability of the inkjets.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink delivery system in a printer comprising:

a printhead;

an ink reservoir operatively connected to the printhead to provide ink to the printhead;

an air pressure pump operatively connected to the ink reservoir, the air pressure pump being configured to apply pressure to ink in the ink reservoir and the printhead;

a valve operatively connected between the ink reservoir and the air pressure pump, the valve being configured to be moved to a first position where the ink reservoir is vented to atmosphere pressure and to a second position where the air pressure pump applies pressure to the ink reservoir; and a controller operatively connected to the valve and the air pressure pump, the controller being configured to operate the valve to connect the air pressure pump to apply pressure sufficient to extend an ink meniscus at inactive inkjets in the printhead without breaking the ink meniscus and to operate the valve to disconnect the air pressure pump from the ink reservoir and vent the ink reservoir to atmospheric pressure to retract the ink meniscus at the inactive inkjets.

2. The ink delivery system of claim 1 wherein the controller is further configured to operate the air pressure pump to apply a predetermined pressure to the ink reservoir.

3. The ink delivery system of claim 2 wherein the controller is further configured to deactivate the air pressure pump while operating the valve to keep the air pressure pump connected to the ink reservoir.

4. The ink delivery system of claim 3 wherein the controller is further configured to operate the valve to disconnect the air pressure pump from the ink reservoir and connect the ink reservoir to atmospheric pressure.

5. The ink delivery system of claim 4 wherein the controller is further configured to operate the valve to disconnect the air pressure pump and connect the ink reservoir to atmospheric pressure after a predetermined time period has expired since the air pressure pump was deactivated.

6. The ink delivery system of claim 5 further comprising:

a sensor operatively connected to the ink reservoir, the sensor being configured to generate a signal indicative of a pressure in the ink reservoir; and the controller is operatively connected to the sensor to receive the signal generated by the sensor, the controller being further configured to compare the pressure indicated by the signal from the sensor to a reference atmospheric pressure and waiting to operate the valve to connect the air pressure pump to the ink reservoir until the pressure indicated by the signal from the sensor corresponds to the reference atmospheric pressure.

7. The ink delivery system of claim 6, the controller being further configured to deactivate the air pressure pump when the pressure indicated by the signal from the sensor corresponds to the predetermined pressure.

8. The ink delivery system of claim 7 wherein the controller is further configured to operate the valve to reconnect the air pressure pump to the ink reservoir and activate the air pressure pump after another predetermined time period has expired since the signal from the sensor corresponds to the reference atmospheric pressure.

9. The ink delivery system of claim 8 wherein the controller is further configured to repeat a cycle of applying pressure to the ink reservoir to extend the ink meniscus at the nozzles of the inactive inkjets in the printhead and releasing the applied pressure to atmosphere to retract the ink meniscus at the nozzles of the inactive inkjets in the printhead for a predetermined number of times.

10. The ink delivery system of claim 9 wherein the ink reservoir is operatively connected to a plurality of printheads.

11. A method of reducing evaporation of ink from printheads in a printer comprising:

operating with a controller a valve operatively connected between an air pressure pump and an ink reservoir connected to a printhead to connect the air pressure pump to the ink reservoir;

activating with the controller the air pressure pump to apply pressure to ink in the ink reservoir to extend an ink meniscus at inactive inkjets in the printhead without breaking the ink meniscus; and operating with the controller the valve to disconnect the air pressure pump from the ink reservoir and vent the ink reservoir to atmospheric pressure to retract the ink meniscus at the inactive inkjets.

12. The method of claim 11 further comprising:

operating with the controller the air pressure pump to apply a predetermined pressure to the ink reservoir.

13. The method of claim 12 further comprising:

deactivating the air pressure pump with the controller while operating the valve to keep the air pressure pump connected to the ink reservoir.

14. The method of claim 13 further comprising:

operating the valve with the controller to disconnect the air pressure pump from the ink reservoir and connect the ink reservoir to atmospheric pressure.

15. The method of claim 14 wherein the controller operates the valve to disconnect the air pressure pump and connect the ink reservoir to atmospheric pressure after a predetermined time period has expired since the air pressure pump was deactivated.

16. The method of claim 15 further comprising:

generating with a sensor operatively connected to the ink reservoir a signal indicative of a pressure in the ink reservoir; and comparing with the controller the pressure indicated by the signal from the sensor to a reference atmospheric pressure; and operating the valve with the controller to connect the air pressure pump to the ink reservoir when the controller determines the pressure indicated by the signal from the sensor corresponds to the reference atmospheric pressure.

17. The method of claim 16 further comprising:

deactivating the air pressure pump with the controller when the pressure indicated by the signal from the sensor corresponds to the predetermined pressure.

18. The method of claim 17 further comprising:

operating the valve with the controller to reconnect the air pressure pump to the ink reservoir; and activating the air pressure pump with the controller after another predetermined time period has expired since the signal from the sensor corresponds to the reference atmospheric pressure.

19. The method of claim 18 further comprising:

repeating with the controller a cycle of applying pressure to the ink reservoir to extend the ink meniscus at the nozzles of the inactive inkjets in the printhead and releasing the applied pressure to atmosphere to retract the ink meniscus at the nozzles of the inactive inkjets in the printhead for a predetermined number of times.

20. The method of claim 19 wherein the ink reservoir is connected to a plurality of printheads.

* * * * *